United States Patent [19]

Baker

[11] 3,983,814

[45] Oct. 5, 1976

[54] READING TYPE

[76] Inventor: Ray E. Baker, 618 Grosvner, Elk Grove Village, Ill. 60007

[22] Filed: July 16, 1973

[21] Appl. No.: 379,569

[52] U.S. Cl. ..... 101/426; D64/12 R; D64/12 A; D64/12 B; 101/399; 197/36; 199/66

[51] Int. Cl.[2] ..... B41B 1/02

[58] Field of Search ..... 101/398, 399, 426; 197/36, 37; 199/66; D64/12 A, 12 B, 12 C, 12 R

[56] References Cited

UNITED STATES PATENTS

| | | | |
|---|---|---|---|
| 495,667 | 4/1893 | Dunning | 101/398 |
| D6,989 | 11/1873 | Ilenburg | D64/12 C |
| D7,145 | 1/1874 | Bauer | D64/12 B |
| D10,022 | 5/1877 | Herriet | D64/12 B |
| D10,767 | 8/1878 | Herriet | D64/12 B |
| D12,644 | 12/1881 | Will | D64/12 B |
| D12,975 | 6/1882 | Thorp | D64/12 A |
| D42,923 | 8/1912 | Mason | D64/12 B |
| D99,721 | 5/1936 | McDougal | D64/12 B |
| D144,880 | 5/1946 | Wiesner | D64/12 B |
| D147,117 | 7/1947 | Deckard | D64/12 B |

OTHER PUBLICATIONS

Pro type Lettering Styles, Copyright 1958, pages–cover–A,B,D,16.

Specimens of Printing Types, MacKellar, Smiths & Jordan Co. Library Dec. 7, 1931, Call No. Z–25-0–M154, pp. 238, 246, 290.

*Primary Examiner*—Clyde I. Coughenour

*Attorney, Agent, or Firm*—Dominik, Knechtel, Godula & Demeur

[57] ABSTRACT

More easily readable matter is provided by intelligible characters which have spaced stroke components and a contrast space between the stroke components, the stroke components forming the intelligible character so that the width is at least about 20% greater than the height. The component strokes have mass or weight which does not exceed 5% of the contrast space with horizontal stroke components; and which does not exceed 30% of the contrast stroke with vertical space components. Cut-ins at stroke component junctions and spurs at outside corners of stroke components allow printing of the intelligible characters without objectionable rounding or filling-in.

6 Claims, 9 Drawing Figures

READING TYPE

This invention relates to a method and product wherein intelligible characters are placed so more easily readable matter results. The invention also relates to presenting such more easily readable matter with space economies.

Familiar reading practice provides moving the eye from left to right on a horizontal line. It is desirable to present intelligible characters as readable matter to enhance the ease of such readable matter in a horizontal path.

It will be appreciated that identifying intelligible characters, such as alphabetical letters, will be improved if the mass or weight of the letter is concentrated. Other than size, optical perception of letters is a function of balancing or proportioning the weight and the white space adjoining the weight of the letter. It is desirable to balance or proportion such contrast space and letter weight to provide greater readability.

The art of printing is characterized by problems when printing smaller sized letters of 12 points or less. Letters have generally vertical and horizontal stroke components such as the letter *h*. An objectionable rounding or filling has occurred where the horizontal stroke component, somewhat curved, joins the vertical stroke component, for example. Such rounding or filling becomes even more objectionable when using lower grade or porous paper. Such junction lines are common in alphabetical letters and occur also with angled component strokes as in the letter *v*.

It is one important object of the present invention to provide an improved method and product wherein intelligible characters are presented in a more easily readable form which utilizes common horizontal reading patterns to represent the intelligible characters in an optically effective way.

Still yet another important object of the present invention is an improved method and product of the type described which additionally permits smaller size printing to be read more comfortably and easily by providing wide letters and by balancing the weight and white space of the letters. It is an aspect of this object that the mass of the letters is increased as the letter size is decreased while still retaining the correct size relation of the white space to the weight of the letter. It is still another aspect of this object that more lines of improved readable matter are attained for a given space to provide a greater number of intelligible characters, even though the number of characters per line are somewhat reduced.

Still yet another important object of the present invention is to provide an improved method and product of the type described which will allow the use of wider and heavier weighted letters at smaller print sizes of twelve points or less, without objectionable rounding or filling of junction corners and outside corners of letters, especially when using lower grade papers.

Still yet another important object of the present invention is an improved method and product of the type disclosed which additionally provides improved readability by flattening and weighting floating strokes of certain letters and by biasing the ends of upper and intermediate horizontal stroke components so that white space is provided between similar letters adjoined in substantial edge to edge relationship.

Yet still another important object of the present invention is to utilize the advantages of the method and product previously described to obtain both an improved type and improved font which can be used to print more readable matter in an easier form in a given space. The present invention therefore leads to advantages of increased average reading speeds, reduction of eye strain, economies of printed space, and production of sharper images printed on poorer grades of paper stock. All the above objects and advantages are attained together with still other objects and advantages which will occur to practitioners from considering the invention shown in the following disclosures, which includes drawings wherein:

Figure 1:
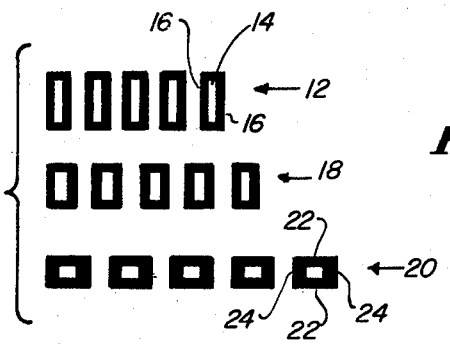
FIG. 1 is a schematic illustration of different printing sizes and letter weights.

The schematic representation of FIG. 1 will illustrate the advantages of the wide letters and the balancing of weight and white space showing a number of representative letters, each one drawn as heavy as the condensity allows. The condensity limitation requires the white space 14 to be at least as wide as are the the weights of the vertical components 16. The row shown generally as 18 has letters with a height or letter size which is ¾ the size of the letters in row 12. Again, the individual representative letters are drawn with as heavy a weight as the proportion to the white space allows. The letters represented in row 20 have a height or size which is ½ the point size of the letters represented in row 12.

A total of 22¼ letters of the point size and weight shown in row 12 can be presented in a given line. A total of 18½ letters of the type illustrated in row 18 can be presented in that same line; and a total of 14 letters represented in row 20 can be presented in that same line. The dark mass or area of each letter representation in row 18 is 2% greater than the total mass of each letter representation in row 12; and the total mass of each letter representation in row 20 is 11% greater than the total mass of each letter representation in row 12.

The represented letters of row 20 are only ½ the size of the letter representations in row 12, and only ⅔ the point size of letters represented in row 18. Yet, the letter representations in row 20 appear optically to be much heavier, even though the total area of the mass is only 11% greater.

A greater number of representative letters in row 20 can be presented on a given space of a receiving surface such as paper. Although fewer representative letters can be placed in a single line, a greater number can be presented in the given space since more lines are possible because the point size is ½ the point size of the representative letters in row 12.

It is accordingly provided by the teachings of the invention that intelligible characters such as alphabetical letters have separated stroke components which represent the weight, of the letter, and a separating white area or contrast space. The spaced stroke components participate in definition mass or dark area of the height and width of the letters. The enhanced readability is attained by providing lower case letters where the width is at least about 20% greater than the height of the letter. Increases in width substantially less than 20% do not permit optical perception of the wide letters for more convenient and speedier reading.

The teachings of the invention also provide that the separated stroke components may include both vertical and horizontal components. Likewise, the spaced components may include angular components such as the letters *k* or *x*. It will be appreciated that the horizontal components may be somewhat curved as in the letter *h*; and that the vertical components may likewise be somewhat curved as in the letter *b*. In any event, it is further provided in accordance with the teachings of the present invention that the total weight of horizontal components be not in excess of about 5% of a dimension of the white or contrast space. This will be the greatest dimension where the white space dimension varies, as in the letter *y*. The vertical stroke components can be heavier, and it has been found that the total of vertical stroke components should not exceed about 30% of the white space dimension. In row 20, the horizontal components 22 are seen to have a substantially lesser weight than the vertical components 24.

The wide letters, with balanced weight and space, allow smaller point size printing while still providing comfortable and speedy reading. It is a problem, however, to neatly print a typed product in smaller point sizes below 12 points. Rounding or filling-in occurs at inside and outside corners. This problem is aggravated when using lower grade or porous paper stock.

Figure 2:
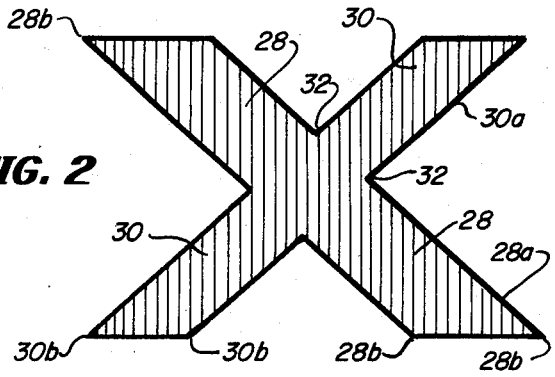
FIG. 2 is a schematic illustration of a letter type known in the art.
Figure 3:
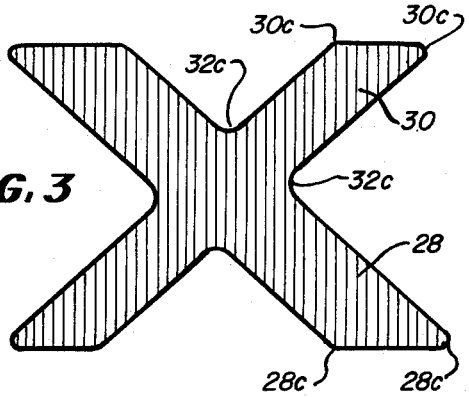
FIG. 3 is a schematic representation of a letter printed from the type of FIG. 2, either in small printing size or on poor grade paper, or both.

Looking at FIGS. 2 and 3, the letter *x* is shown with angular stroke components 28 and 30. A straight side 28*a* forms an inside corner or junction 32 with side 30*a* of angular component 30. In the letter *x*, side 30*a* is also straight to form an inside corner or junction 32, but it could be a curvilinear side and still form a junction. Further, the angular components form outside corners such as 28*b* in angular component 28 and 30*b* in angular component 30.

Conventional letter types such as that illustrated in FIG. 2 result in the problems represented in FIG. 3 when printed in small point sizes less than 12, or when printed on poor grade paper. The junctions or inside corners 32 are filled or rounded as shown at 32*c*. Likewise, the outside corners become filled or rounded as shown in 28*c*. This is optically undesirable.

Figure 4:
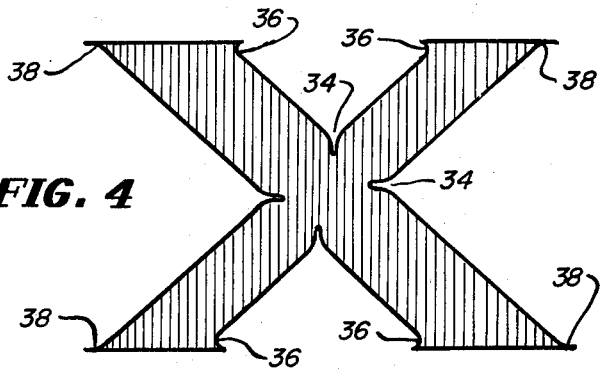
FIG. 4 is a schematic illustration of an improved letter type shown in the present invention.
Figure 5:
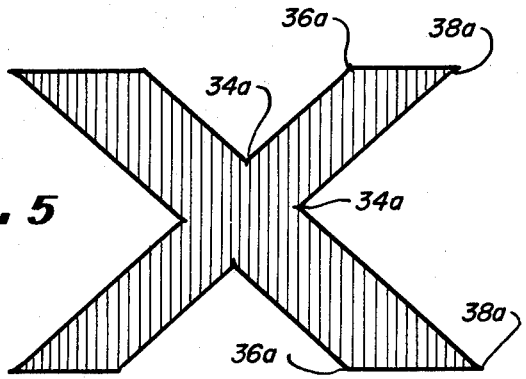
FIG. 5 is a schematic illustration of the letter printed with the type shown in FIG. 4, illustrating absence of objectionable rounding or filling at junction points and outside corners.

The filling or rounding of inside and outside corners is eliminated in small point printing, or printing on poor grade paper, by providing a type as illustrated in the view of FIG. 4. The inside corners or junctions are provided with recessed portions shown generally as V-shaped cut-ins 34. The outside corners of the angular components are provided with spurs such as shown at 36. The illustrated letter is provided with conventional serifs on some of the outside corners as shown at 38. Such conventional serifs are oversized relative to the spurs 36, and appear in the printed letter at 38*a* as shown in the view of FIG. 5. However, the V-shaped cut-ins 34 result in optically neat printed angles 34*a*, and the spurs result in optically neat corners 36*a*. Cut-ins should be at least ⅛ inch for a 3 inch high letter and this ratio should be maintained for smaller letters.

Figure 6:
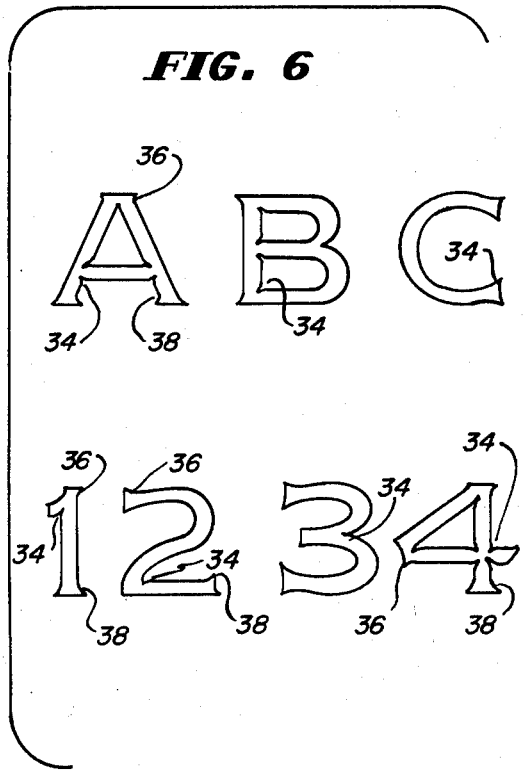
FIG. 6 is a random illustration of various intelligible character types provided with junction cut-ins and outside corner spurs to overcome the problem of objectionable filling or rounding in smaller size printing, printing on poor grade paper, or both.

FIG. 6 illustrates representative letters and numerals provided with cut-ins 34 at inside corners and spurs 36 at outside corners. Such intelligible characters are also shown with the extended serifs as at 38.

Figure 7:
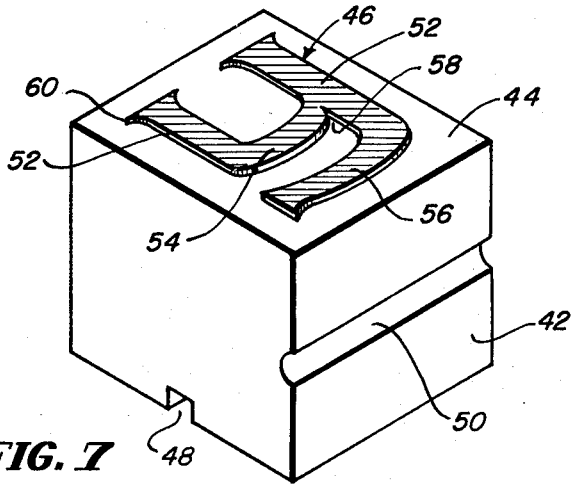
FIG. 7 is a highly schematic illustration of an intelligible character type element.

A printing letter type is shown generally in the view of FIG. 7. Such type includes a support body 42 having a face 44 with a raised intelligible character 46 thereon. Engaging means are provided on the support body to allow execution of the printing operation, and such engaging means are shown as the groove 48 and nick 50 found on type blocks. The intelligible character *y* has a greater width than height as defined by spaced vertical components 52, as well as curved horizontal components 54. The height of the overall letter is extended by a long descender stroke component 56 which can be positioned closer to horizontal component 54 or be extended downwardly depending on how the available space is to be utilized. The letter is shown with the V-shaped cut-ins as at 50*a*, and a spur as at 60.

Figure 8:
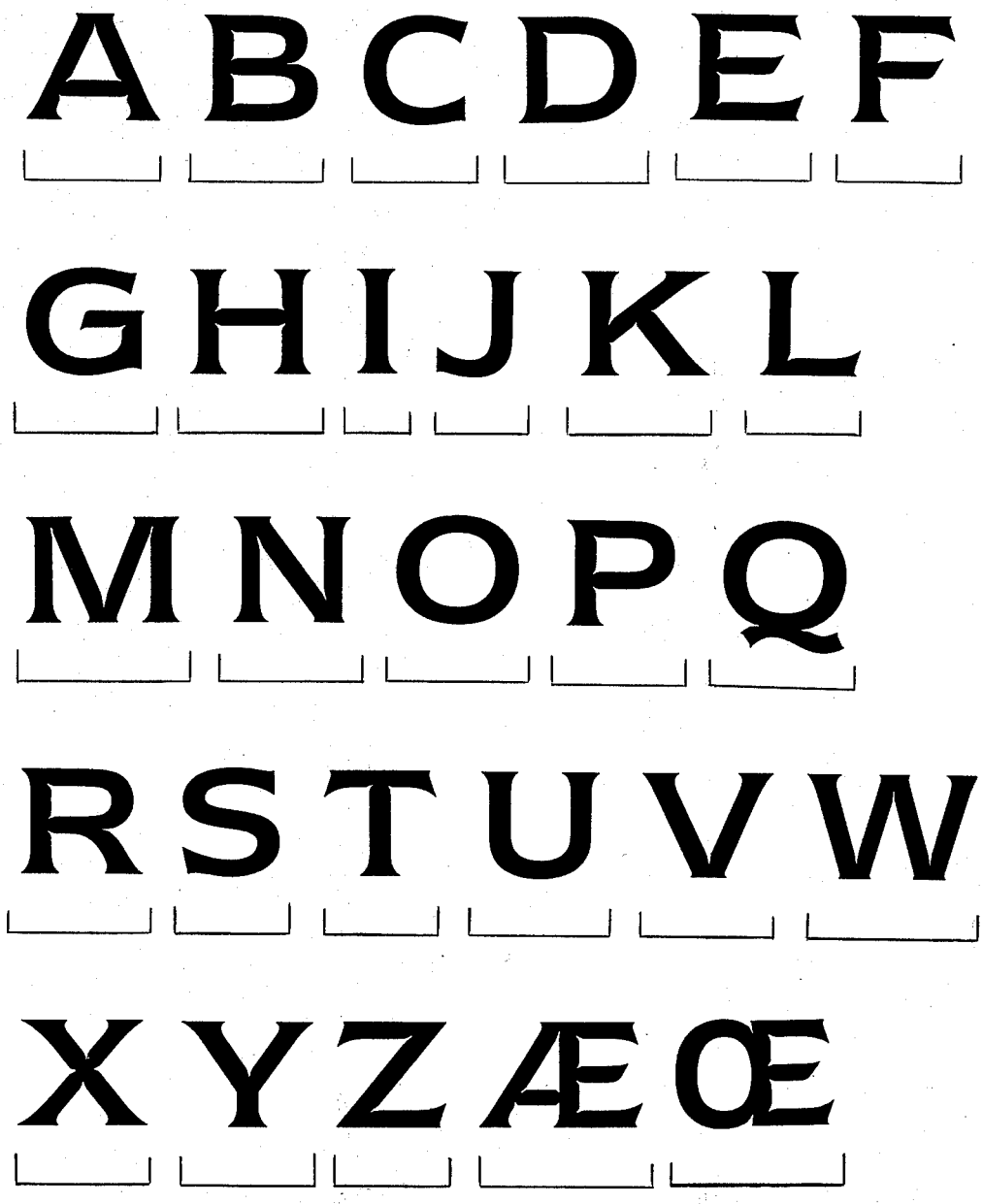
FIG. 8 is an illustration of large case alphabetical letter types provided with cut-ins and spurs similar to those shown in the letters of FIG. 6.
Figure 9:
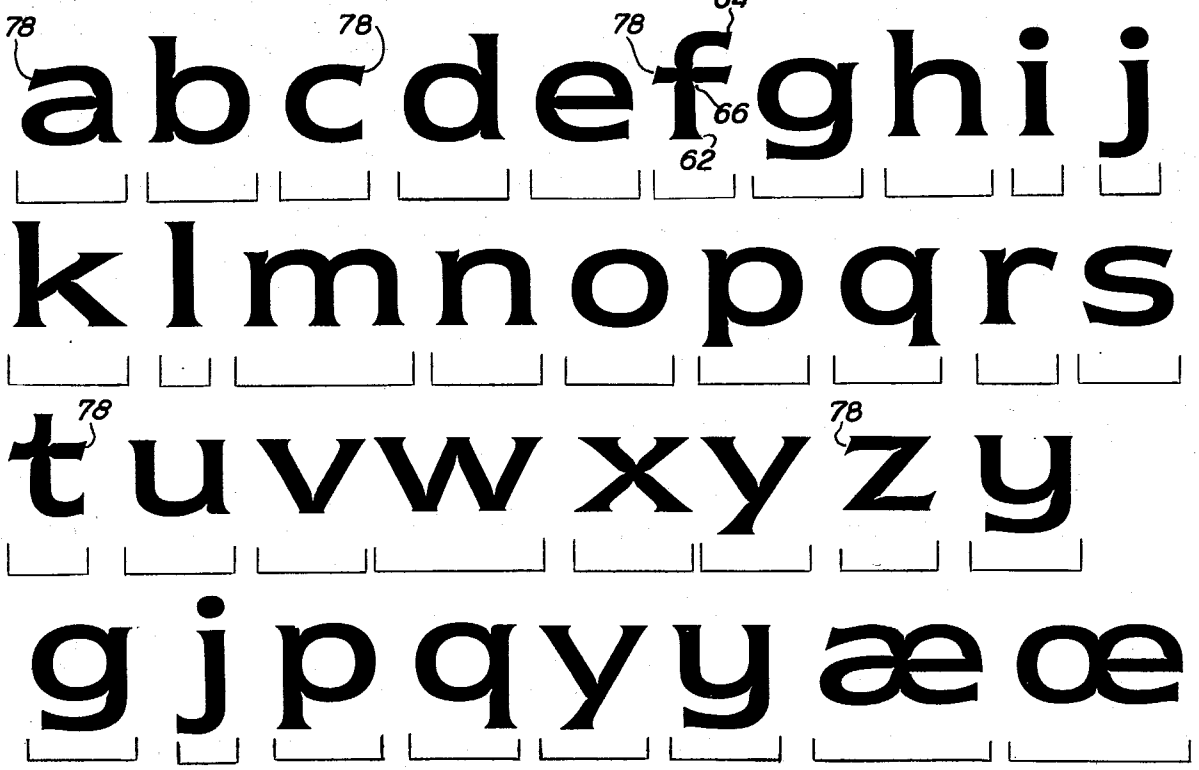
FIG. 9 is an illustration of lower case normal alphabetical letter types similarly provided with cut-ins and spurs.
Figure 10:
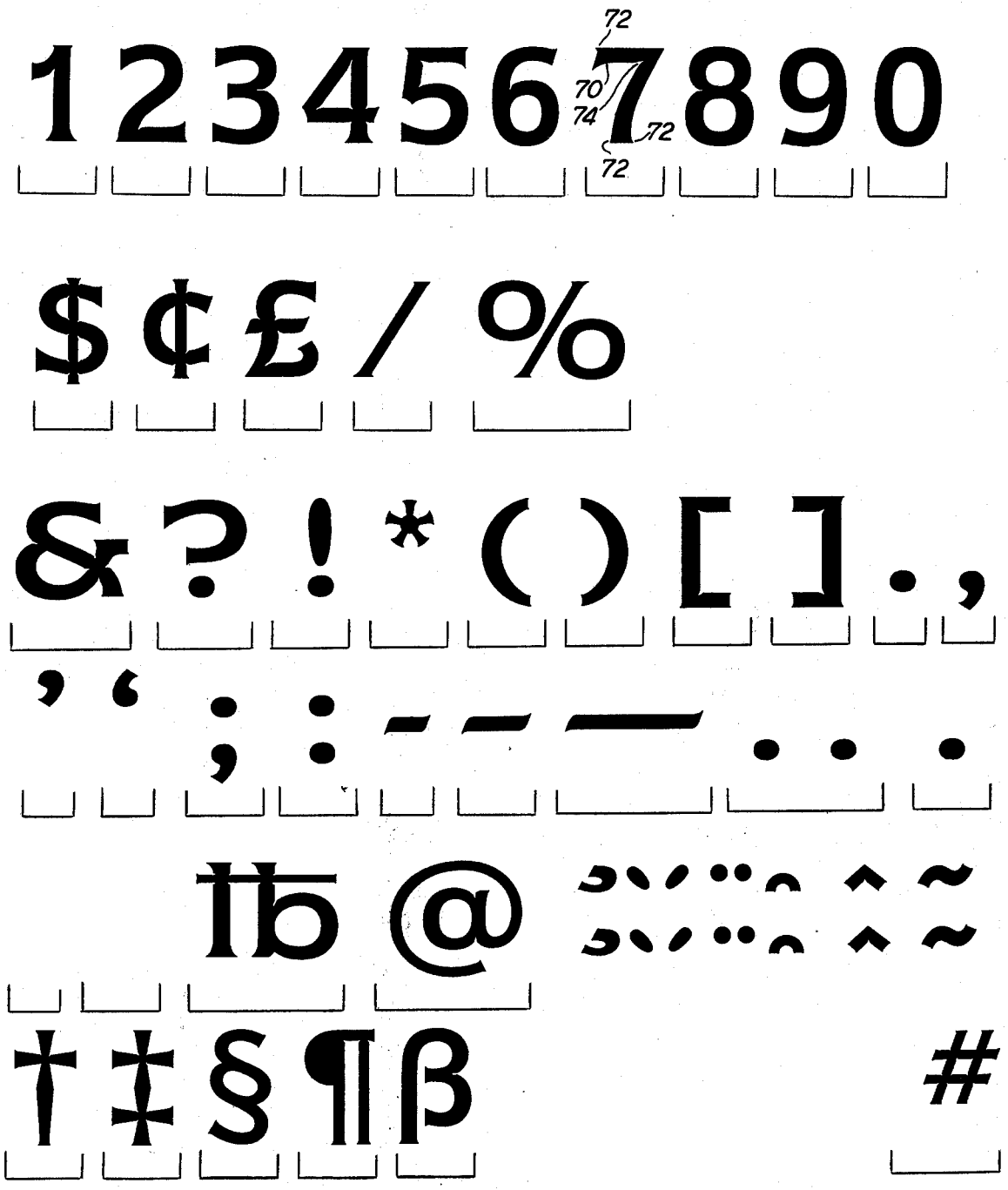
FIG. 10 is a representation of numerical and other intelligible character types likewise formed with cut-ins and spurs as previously described.

FIG. 8 illustrates large case normal alphabetical letters with their various widths indicated by underlying line demarcations. Similarly, FIG. 9 illustrates lower case alphabetical letters. The letters in both FIGS. 8 and 9 are intended to represent letter types for printing, therefore, being provided with V-shaped cut-ins at inside corners and spurs at outside corners. The larger projections at the outside corners are serifs 62, and the shorter ones are spurs as at 64. The V-shaped cut-ins are shown at 66. See the letters F and *f* in FIGS. 8 and 9. FIG. 10 shows normal numerals and various punctuations and symbols, the underlying line demarcations likewise indicating width of the various intelligible characters. Numeral 7 shows a serif at 70, a spur at 72 and the cut-in at 74. Looking further at FIG. 9, the letter *y* has been identified as including a long descender to extend the height of the letter defined by the spaced stroke components and the intermediate contrast space. Similar long descenders are seen in the first six letters of the last row, namely *g,j,p,q*, and both forms of *y*. The letters *i* and *l* may also be considered as including a long descender.

Referring again to FIG. 9, certain letters are seen to have a floating horizontal stroke component, namely, *a,c,e,g,s,r*, and the last representation of the letter *y*. Optical perception is improved by effecting a substantially flat floating horizontal stroke, and further slightly weighting the floating stroke relative to the mass of the other stroke components.

Other than the vertical and horizontal stroke components, some letters, as shown in FIG. 9, illustrate angular stroke components. These are letters *k,v,w,x,y*, first illustrated form in row 3. The greatest dimension of the white space in such angular component letters is considered relative to the weight of such letters to obtain the desired weight and white space proportioning. The upper half of a letter is more readily perceived optically than the lower half, therefore, descender angular strokes can be shorter than the ascender strokes as in *k*. In general, ascenders and descenders can be shortened to impart the appearance of greater height to the body of a lower case letter. This occurs because the vertical component in the letter *k* extends the height of the letter, which optical effect is basically set by the extremes of the ascender and descender component strokes.

Referring still to FIG. 9, certain letters have upper horizontal stroke components such as *a,c,r,s*. Other letters have intermediate or lower horizontal stroke components as *f,t,z*. The free ends of such upper and intermediate stroke components are biased as at 78. The biased ends are complementary to each other when the letters are positioned in substantial edge to edge relationship as, for example, two lower case letters *f*. This will allow the letters to be positioned alongside one another closely in substantial edge to edge relationship while still providing a white or clear space between the complementary ends formed on a bias.

The optical effect is improved as a result of this spacing.

It is also desirable to provide letters with reduced serifs so that the letters can be more closely grouped together. In general, the extending serif is reduced sufficiently to attain a desired adjoining edge to edge relationship of the letters, up to substantial edge to edge contact.

FIG. 10 illustrates certain numerals for teletype use such numerals being somewhat narrower than conventional type. FIG. 10 also illustrates other intelligible characters found in conventional printing, all the characters of FIG. 10 illustrating features of the invention.

Following Table I illustrates the relative width of normal and teletype upper case and lower case letters, numerals and various punctuation symbols. The proportions are based on the 18 unit system in that the largest letter *w* is assigned a value of 18 for upper case and 17 for lower case. The smallest width is the letter *i*, upper and lower case, as seen in the chart. In all such lower case letters, the width must be at least 20% greater than the height.

TABLE 1

PROPORTION CHART (18 Unit System)

| CAPS | | | Lowercase | | | Numerals & Punc. | | |
|---|---|---|---|---|---|---|---|---|
| | Normal Units | Tele-type Units | | Normal Units | Tele-type Units | | Normal Units | Tele-type Units |
| A | 14 | 14 | a | 11 | 11 | 1 | 5 | 9 |
| B | 14 | 14 | b | 11 | 11 | 2 | 11 | 9 |
| C | 13 | 13 | c | 9 | 10 | 3 | 12 | 9 |
| D | 15 | 15 | d | 11 | 11 | 4 | 12 | 9 |
| E | 14 | 15 | e | 11 | 10 | 5 | 12 | 9 |
| F | 13 | 14 | f | 8 | 7 | 6 | 13 | 9 |
| G | 15 | 15 | g | 11 | 11 | 7 | 11 | 9 |
| H | 15 | 15 | h | 11 | 11 | 8 | 14 | 9 |
| I | 7 | 8 | i | 5 | 6 | 9 | 13 | 9 |
| J | 10 | 11 | j | 5 | 6 | 0 | 14 | 9 |
| K | 15 | 15 | k | 12 | 11 | | | |
| L | 12 | 13 | l | 5 | 6 | $ | 9 | 9 |
| M | 18 | 18 | m | 17 | 18 | ¢ | 9 | 9 |
| N | 15 | 15 | n | 11 | 11 | £ | 13 | 9 |
| O | 15 | 14 | o | 11 | 10 | & | 14 | 14 |
| P | 14 | 14 | p | 11 | 11 | ? | 11 | 11 |
| Q | 15 | 14 | q | 11 | 11 | | | |
| R | 15 | 15 | r | 8 | 9 | | | |
| S | 12 | 11 | s | 10 | 9 | | | |
| T | 12 | 13 | t | 8 | 7 | | | |
| U | 15 | 15 | u | 11 | 11 | | | |
| V | 14 | 14 | v | 11 | 11 | | | |
| W | 18 | 18 | w | 17 | 15 | | | |
| X | 14 | 15 | x | 12 | 11 | | | |
| Y | 14 | 15 | y | 11 | 11 | | | |
| Z | 12 | 12 | z | 10 | 9 | | | |

Following Table II presents a listing of various weights and proportions for capital or upper case normal letters, the relative language of the weight and proportions being based on H.

TABLE II

CAPITAL LETTERS (Weight and proportions)
Normal weight and proportion based on capital letter "H"

| | |
|---|---|
| A | Outside bottom serifs minimized to keep letterspacing closer. Both diagonals drawn lighter. Letter tends to weight when small. |
| B | Normal drawing. |
| C | Normal drawing. |
| D | Normal drawing. |
| E | Spurs on right of top and bottom horizontals. Lower serif on center stroke eliminated to allow more white space. |
| F | Spur on right of top horizontal. Center stroke has bottom part of serif eliminated for more white space and to have similar appearance of capital "E". |
| G | Center horizontal stroke exaggerated for faster letter identification. Spurs on lower left and upper right of the center stroke. |
| H | Normal drawing. |
| I | Drawn heavier due to the tendency of single unattached |

TABLE II-continued

| | |
|---|---|
| | and floating strokes to appear lighter at small sizes. |
| J | Drawn heavier due to the tendency of single unattached and floating strokes to appear lighter at small sizes. |
| K | Top diagonal drawn lighter to cut down black mass at junction with vertical stroke. Lower diagonal drawn heavy as it would otherwise appear light at small sizes. |
| L | Spur on bottom right of horizontal. |
| M | Spurs on diagonals. First three strokes drawn light to keep letter from optically appearing too heavy when small. |
| N | Verticals drawn lighter. Spurs on bottom right base and inside of top of vertical. |
| O | Normal drawing. |
| P | Normal drawing. |
| Q | Spurs on all four corners of lower horizontal. |
| R | Diagonal drawn heavier. |
| S | Normal drawing. |
| T | Spurs on both ends on top of horizontal. |
| U | Entire letter weighted as it looks much too light when reduced to small sizes when it is drawn at a normal weight. |
| V | Outside serifs minimized for better letterspacing. |
| W | Outside serifs minimized for better letterspacing. All strokes drawn lighter than normal to keep letter from appearing too heavy at small sizes. |
| X | Outside serifs minimized for better letterspacing. Letter drawn wider than normal to give more white space. Diagonal drawn lighter to keep letter from appearing too heavy. |
| Y | Outside serifs minimized. Right diagonal drawn lighter. |
| Z | Spurs on top and bottom of horizontals. Diagonal drawn light. |
| a,e,m,n, | are lowercase letters drawn to capital letter heights. These are called commoncase letters and are sometimes used to give more variety to type set in all capitals. |

PUNCTUATION, SPECIAL CHARACTERS AND LIGATURES

All these are drawn to match the weight and unit system of the alphabet. Spurs are added to any corners that are normally drawn with square corners.

Following Table III presents similar weight and proportion relationships for lower case letters, with the relative references being based on the lower case *h*.

TABLE III

LOWER CASE LETTERS (Weights and proportions)
Normal weight and proportion based on lower case "h"

| L.C. | |
|---|---|
| a | Top stroke heavier (Floating stroke) to hold optical visibility at small sizes, also drawn taller than normal to allow more horizontal white space. |
| b | Spur on upper right vertical. |
| c | Horizontals heavier (Floating strokes) Drawn narrow to improve letter spacing |
| d | spur on upper right of vertical stroke. |
| e | Spur on lower right of center stroke. Lower horizontal heavy (Floating stroke) Letter is drawn taller and wider than normal proportion to give additional white space in horizontal areas. Vertical strokes also drawn light because on small reduction they weight up optically due to the middle cross stroke. |
| f | Cross bar is heavy plus spurs. Cross bar is lower than normal to allow more white space between it and the top horizontal. Vertical stroke is also drawn heavier to maintain correct optical weight. |
| g | Upper body of letter is raised above the base line to allow more white space between it and the lower horizontal stroke. |
| h | Spur on upper right of vertical stroke. |
| i | Spur on upper right of vertical stroke. Vertical stroke is also drawn heavier to maintain optical weight at small size. |
| j | Both horizontal and vertical strokes are heavier. Spur on upper right of vertical stroke. |
| k | Drawn wider than normal to keep optical balance of white space. Spur on upper right vertical. Upper diagonal is tapered to keep letter from appearing too heavy at junction with the vertical stroke. Lower diagonal stroke is drawn heavier as it gets light optically at small reductions. |
| l | Spur on upper right vertical. Vertical also drawn heavier. |
| m | Spur on upper right of left vertical stroke. |
| n | Spur on upper right of left vertical stroke. |
| o | Normal drawing. |
| p | Normal drawing |
| q | Normal drawing |
| r | Spur on upper top vertical. Horizontal drawn heavier |
| s | This letter is drawn lighter as it appears optically heavy when reduced to a small size. Drawn wider than normal |
| t | Crossbar is heavy and lower to match height of the lower case "f" in height from baseline. Top of vertical stroke is drawn lighter on left side to increase left |

TABLE III-continued

| | |
|---|---|
| | side of crossbar in optical length. Lower horizontal is drawn heavier because it is a floating stroke. |
| t | (Teletype proportion). This is a problem letter as it must be drawn too narrow to qualify for teletype specifications. To give it better legibility the lower horizontal stroke was eliminated and the vertical stroke above the crossbar was narrowed on both the right and left side. |
| u | Spurs on upper right of both vertical strokes. |
| v | Spurs on bottom of letter. Serifs minimized on outside of the tops of verticals to keep letterspacing from becoming too open. |
| w | Spurs on baseline of letter and two middle diagonal strokes. The second and fourth diagonal strokes were also drawn light to keep the letter from looking optically heavy at small reductions. |
| x | Outside serifs on all four corners were minimized to keep letterspacing from becomeing too open. Both diagonal strokes are drawn lighter to keep appearance of letter from looking heavy at small size. |
| y | Both sides of upper diagonals have been minimized on the outside to keep letterspacing from becoming too open. The "v" part of the letter has been shortened to give more |
| , | length to the lower stroke for better identification. Weight has been added to the bottom of the lower stroke to give better visibility at small sizes. |
| y | The alternate y has a shorter upper body to allow more white space between it and the bottom horizontal stroke. |
| z | Spurs on ends of both ends of horizontals. Diagonal is drawn lighter to keep letter from appearing heavy at small sizes. |
| g,j,p,q,y | and alternate y. These letters have longer descenders to be used where space savings is not an essential consideration. |
| ra | This is needed to close letterspacing in some unitized systems. Can not be used in Teletype system |
| ft | This ligature also helps close up letterspacing in some unitized systems. Can not be used for Teletype system. |

NUMERALS

| | |
|---|---|
| 1 | Spurs on both sides of top vertical. Vertical is heavier. |
| 2 | Spurs on ends of horizontal. |
| 3 | Spurs on end of center stroke. |
| 4 | Spurs on all outside corners. |
| 5 | Spurs on top horizontal and center stroke. |
| 6 | Normal drawing. |
| 7 | Spur on top left of horizontal. |
| 8 | Normal drawing. |
| 9 | Normal drawing. |
| 0 | Normal drawing. |

A wider set of numerals has been drawn to be used for work that is non-tabular in nature. These numerals cannot be used in the Teletype unitized system.

Two different sets of fractions have been drawn. One with a diagonal bar, one with a horizontal bar. The set with the horizontal bar has been drawn taller to give more height to the individual numerals.

The claims of the invention are now presented, the terms of such claims may be better understood by reference to the language of the preceding specification and the views of the drawings.

What is claimed is:

1. A method for printing letter and numeral characters of a size not exceeding 12 points so that inside and outside corners formed between the straight side of one stroke component and a side of another stroke component are not printed with objectionable rounding, which includes the steps of forming a generally V-shaped cut-in at said inside corner and forming a spur at said outside corner, dimensioning said cut-in and spur so that the printed letter is formed without objectionable rounding at said inside and outside corners and printing said character on a receiving surface so that the resulting printed character is free of cut-in, spur and objectionable rounding at said inside and outside corners.

2. A method which includes the steps of claim 1 above, wherein a spur is formed at an outside corner by extending a serif at such outside corner.

3. A method which includes the steps of claim 1 wherein said inside corner is formed by straight sides of angular stroke components.

4. A method which includes the steps of claim 1 wherein said inside corner is formed by a straight side of a vertical stroke component and a straight side of an angular stroke component.

5. A method which includes the steps of claim 1 wherein said inside corner is formed by a straight side of a vertical component and a straight side of a horizontal component.

6. A method which includes the steps of claim 1 wherein said inside corner is formed by a straight side of a vertical component and a curvilinear side of a horizontal component.

* * * * *